US010405075B2

(12) United States Patent
Cheney et al.

(10) Patent No.: US 10,405,075 B2
(45) Date of Patent: Sep. 3, 2019

(54) WIRELESS SPEAKER HAVING USER CONFIGURABLE STRAP

(71) Applicant: Zagg Amplified, Inc., Midvale, UT (US)

(72) Inventors: John Craig Cheney, Orem, UT (US); Robert Murdock, Lindon, UT (US)

(73) Assignee: ZAGG Amplified, Inc., Salt Lake City, UT (US)

( * ) Notice: Subject to any disclaimer, the term of this patent is extended or adjusted under 35 U.S.C. 154(b) by 0 days.

(21) Appl. No.: 15/333,019

(22) Filed: Oct. 24, 2016

(65) Prior Publication Data

US 2017/0195763 A1 Jul. 6, 2017

Related U.S. Application Data

(60) Provisional application No. 62/275,623, filed on Jan. 6, 2016.

(51) Int. Cl.

| | |
|---|---|
| ***H04R 1/02*** | (2006.01) |
| ***A45F 5/00*** | (2006.01) |
| ***A45C 13/00*** | (2006.01) |
| ***A45F 5/10*** | (2006.01) |
| ***H04R 1/18*** | (2006.01) |
| *A45C 11/00* | (2006.01) |

(52) U.S. Cl.

CPC ..... *H04R 1/026* (2013.01); *A45C 13/00* (2013.01); *A45F 5/00* (2013.01); *A45F 5/10* (2013.01); *H04R 1/18* (2013.01); *A45C 11/00* (2013.01); *H04R 2420/07* (2013.01)

(58) Field of Classification Search

CPC ..... H04R 1/02; H04R 1/2892; H04R 2201/02

USPC ..... 381/334, 87, 333, 336, 374; 294/137; 224/218

See application file for complete search history.

(56) References Cited

U.S. PATENT DOCUMENTS

| | | | | |
|---|---|---|---|---|
| 4,081,850 | A * | 3/1978 | Walden | G11B 23/0236 224/610 |
| 4,237,341 | A * | 12/1980 | Richards | H04R 27/04 224/259 |
| D584,287 | S | 1/2009 | Pauschitz et al. | |
| 8,567,832 | B2 * | 10/2013 | Kannaka | A45F 5/00 224/218 |
| D718,741 | S | 12/2014 | Lui et al. | |
| D726,144 | S | 4/2015 | Kang | |
| D745,861 | S | 12/2015 | Kim | |
| 9,271,061 | B1 * | 2/2016 | Amores | H04R 1/028 |
| D756,967 | S | 5/2016 | Manz | |
| 9,407,743 | B1 * | 8/2016 | Hirshberg | H04M 1/04 |
| 9,427,071 | B2 * | 8/2016 | Rayner | A45F 5/10 |

(Continued)

OTHER PUBLICATIONS

Hollington, Jesse, "Braven intros new speakers at CES, including theBRV-XXL and BRV-BLADE LE", http://www.ilounge.com/index.php/news/comments/braven-intros-new-speakers-at-ces-including-the-brv-xxl-and-brv-blade-le, Jan. 7, 2016.

*Primary Examiner* — Disler Paul
(74) *Attorney, Agent, or Firm* — Durham Jones & Pinegar; Sarah W. Matthews; Randall B. Bateman

(57) ABSTRACT

A wireless portable audio speaker having a configurable reversibly attachable strap is disclosed. The strap is configured to be attached to multiple channels on the speaker housing via a rod to easily and quickly facilitate different strap configuration that can enhance the user experience and provide additional versatility to the speaker.

13 Claims, 6 Drawing Sheets

(56) References Cited

U.S. PATENT DOCUMENTS

| | | | | |
|---|---|---|---|---|
| D766,875 | S | 9/2016 | Holzer | |
| D771,015 | S | 11/2016 | Tang | |
| 9,635,445 | B1 * | 4/2017 | Ridley | H04R 1/028 |
| 2009/0074224 | A1 * | 3/2009 | Wright | H04R 1/028<br>381/385 |
| 2012/0082014 | A1 * | 4/2012 | Lai | G04B 37/1493<br>368/282 |
| 2014/0049060 | A1 * | 2/2014 | Rayner | A45F 5/10<br>294/25 |
| 2016/0058375 | A1 * | 3/2016 | Rothkopf | G06F 1/1643<br>600/301 |
| 2017/0231374 | A1 * | 8/2017 | Laydera-Collins | A45F 5/004<br>24/3.4 |

* cited by examiner

WIRELESS SPEAKER HAVING USER CONFIGURABLE STRAP

INCORPORATION BY REFERENCE TO RELATED APPLICATIONS

This application claims benefit under 35 U.S.C. § 119(e) from U.S. Provisional Application No. 62/275,623, filed on Jan. 6, 2016, which is hereby incorporated by reference in its entirety.

BACKGROUND

Field

This patent application generally relates to wireless speakers, and more specifically to such wireless speakers that include configurable hand or mounting straps.

Background Information

These days portable wireless speakers are being used in increasingly varied environments, from protected indoor environments such as in the office, kitchen, and bedroom to more rugged environments such as camping, hiking, climbing, travel, leisure, beach, boating, canoeing, fishing, surfing, paddle boarding, off-road driving. Indeed, it is not uncommon for such speakers to be used in the shower one day and taken on a camping trip the next day. The applicants here, in an effort to continue to enhance the overall user experience, have recognized a need to support the versatility of use for such speakers through new and innovative configurable hand and mounting straps as described herein.

SUMMARY

The subject matter of this disclosure is generally directed to portable battery powered wireless speakers that include configurable hand or mounting straps that can be positioned by the user in different locations on the speaker housing. The aspects and embodiments set forth in the claims, described in the drawings and written description provided or otherwise disclosed herein may be combined to form claims for a device, apparatus, system, methods of manufacture and/or use in any way disclosed herein without limitation.

BRIEF DESCRIPTION OF THE DRAWINGS

These and other features, aspects and advantages, as to its structure, operation, and manufacture are described below with reference to the drawings, in which like reference numerals refer to like parts throughout. Though components in the figures are often illustrated to scale, emphasis of these drawings instead should be placed upon illustrating the principles of the various inventive aspects disclosed herein. Moreover, all illustrations are intended to convey concepts, where relative sizes, shapes and other detailed attributes may be illustrated schematically rather than literally or precisely.

DETAILED DESCRIPTION OF THE PREFERRED EMBODIMENT

Figure 1:
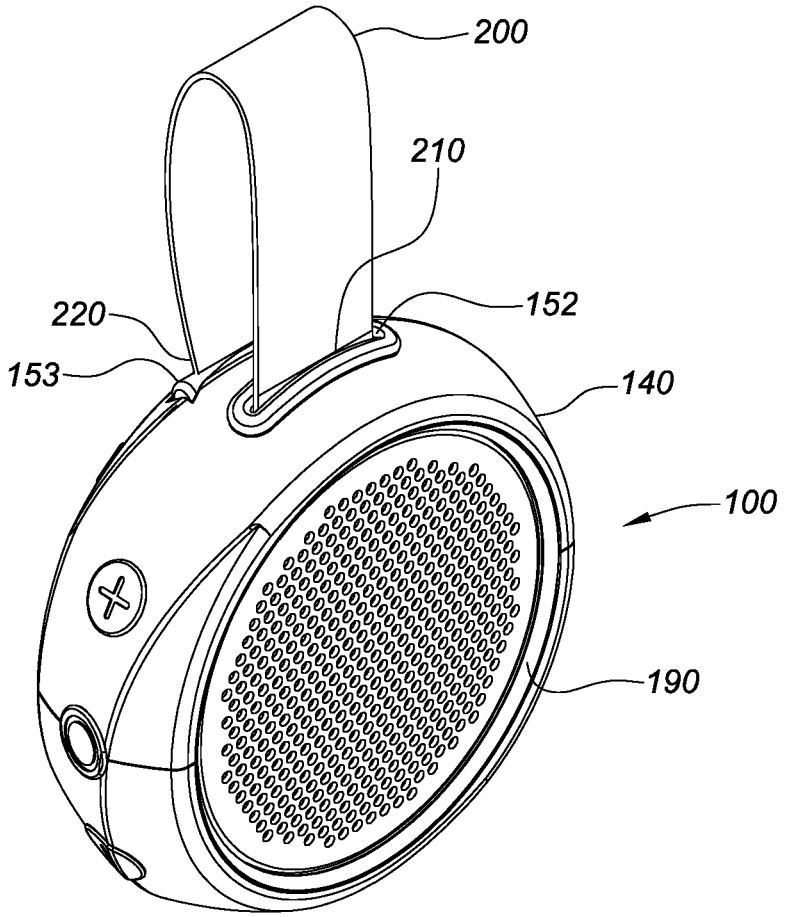
FIG. 1 is a front top side perspective view of a representative wireless portable battery powered stereo speaker with a looped strap attached on both ends to the top side of the speaker in a first configuration position for handling or mounting.
Figure 2A:
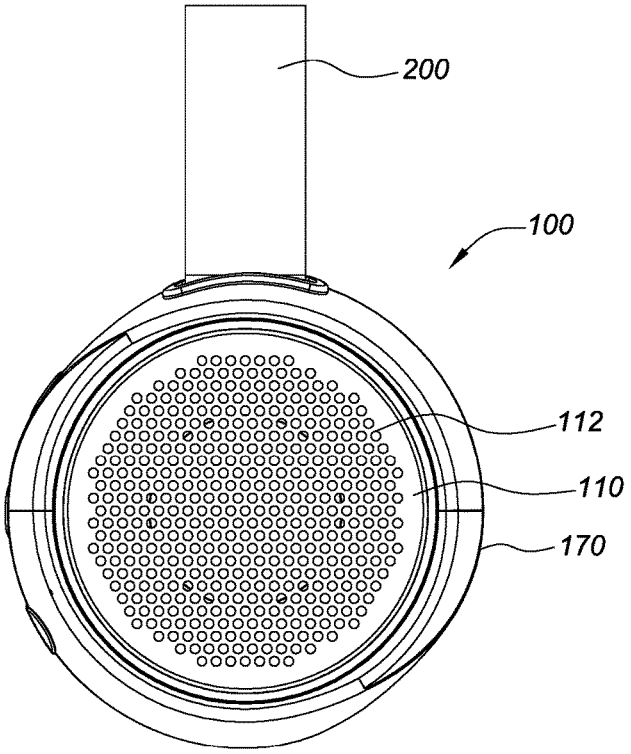
FIGS. 2A-2F are front, rear, left, right, top and bottom views of the speaker illustrated in FIG. 1.
Figure 2B:
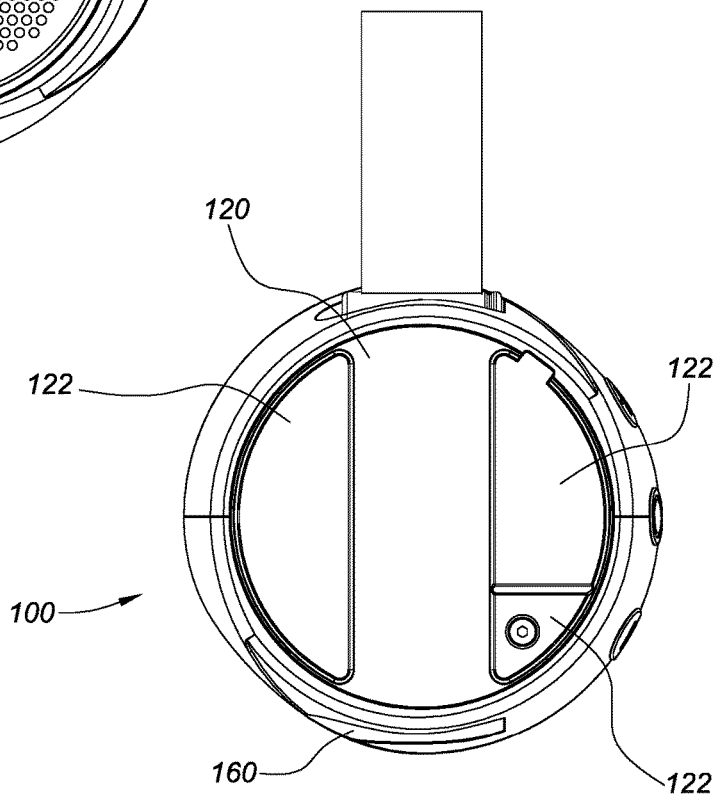
Figure 2C:
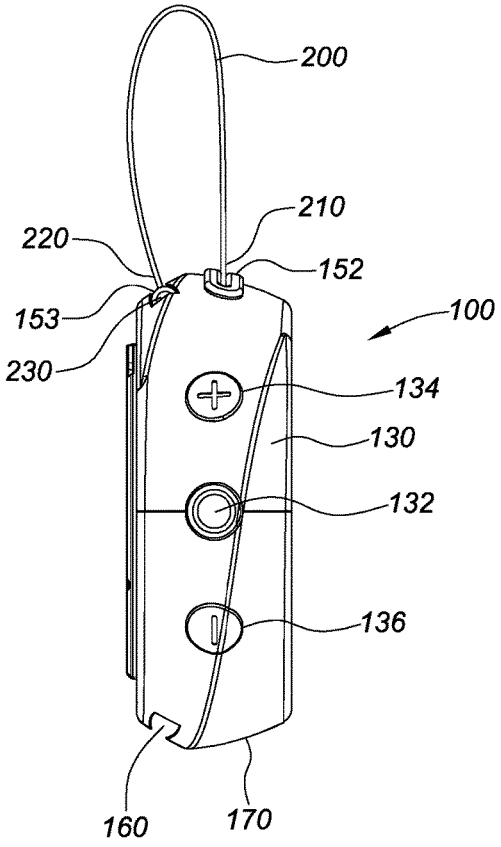
Figure 2D:
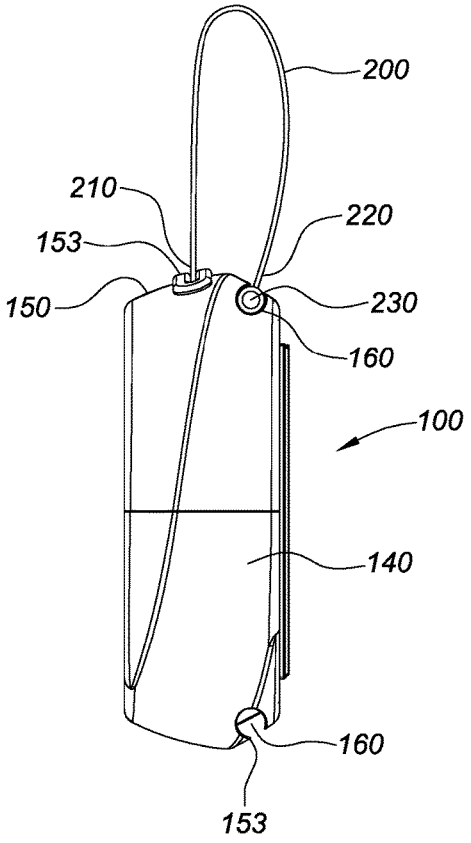
Figure 2E:
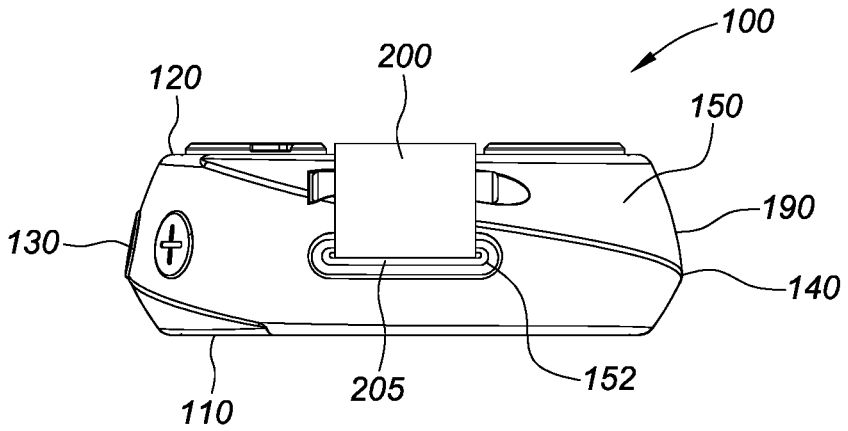
Figure 2F:
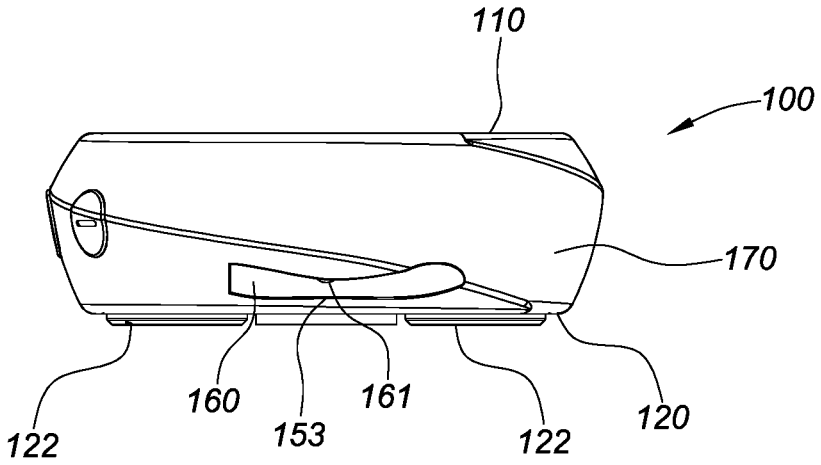
Figure 3:
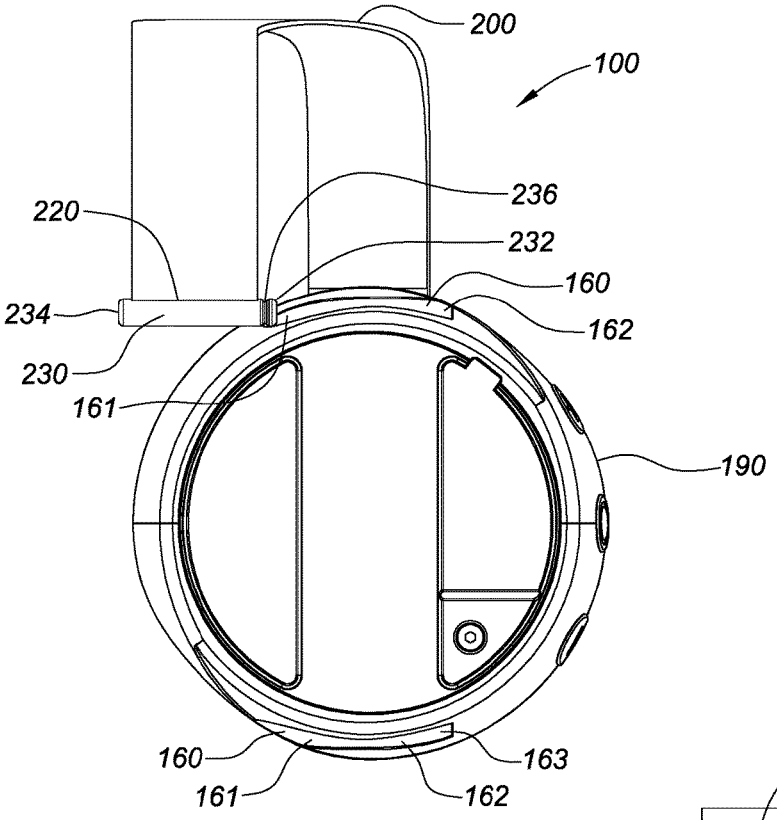
FIG. 3 is a rear view of the speaker illustrated in FIGS. 1-2F with one end of the strap being disconnected from the top side of the speaker.

As illustrated in foregoing drawings in FIGS. 1-5, the speaker 100 includes front, rear, left, right, top, bottom sides 110, 120, 130, 140, 150, 170, respectively, and is comprised of an internal relatively rigid plastic or metal housing or enclosure 190 that houses the speaker electronics, rechargeable battery, wireless (e.g., BLUETOOTH or Bluetooth Low Energy) module and various interfaces. The speaker includes a strap 200 that has a first end 210 and a second end 220 that are connected to or connectable to the housing 190. The second end 220 is configured to be removable and reconnected to the housing 190 at multiple locations. The first end 210 is configured to be either permanently attached to the housing 190 or configured like the second end 220 to be removable and reconnected to the housing 190 at multiple locations.

In the illustrated implementation, the front side 110 of the speaker 100 includes a perforated panel or grill 112 behind which the speaker components reside. The grill 112 may be made of metal, such as aluminum or plastic or fabric or other suitable material. The rear side 120 of the speaker 100 may include one or more feet or stand pads 122 that can provide a support surface and additional impact resistance to the speaker 100 when the rear side 120 is positioned to lie on a support surface so that the front side 110 is facing up. The stand pads 122 may also be included in other regions of the speaker including the left, right, bottom and top sides to allow the speaker to stand when any of those sides are being supported by a support surface. The left side 130 of the speaker 100 includes multiple control buttons, such as power button 132 and volume buttons 134, 136, which facilitate the operation of the speaker.

The top side 150 of the speaker includes a first attachment connection 152 that can fixedly attach the first end 210 of the strap 200 to the top of the speaker housing 190. The first attachment connection 152 may, for example, include a slot or aperture 205 that extends through the housing 190, with the strap 200 being threaded through the aperture 205 in housing 190 and secured mechanically thereto at the first end 210, for example, by an anchor component that is sized larger than the aperture 205. Securing the first end 210 of the strap 200 to the housing at the first attachment connection 152 may also be accomplished by use of adhesive or other mechanical means such as rivets, screws, or clips that attached the first end 210 to the housing 190 at the first attachment connection 152. In this implementation, the first end 210 of the strap 200 would be permanently fixedly attached to the housing 190 at the first attachment connection 152 location. In another embodiment, the first end 210 of the strap 200 is detachable from the first attachment connection 152 location.

The second end 220 of the strap 200 is fixedly attachable and detachable to the housing 190 at multiple attachment connection 153 locations. In the illustrated implementation, the multiple locations are positioned on opposing top and bottom sides 150, 170 of the housing 190. It should be understood, however, that the attachment connections may be elsewhere positioned or be greater in number to allow for greater flexibility and versatility. Thus for example the connections 153 may be provide at the left and right sides or in the middle of the back surface of the speaker housing. Also the position of the first attachment connection 152 may be configured to be located in a corresponding location or proximity to the location of the connections 153.

The second attachment connection 253 is comprised of a rod 230 having a front end 232 and a rear end 234, the rod 230 being permanently attached at the second end 220 of the strap 200 at its mid-section and dimensioned and configured to be received within an open ended 161 and open sided 162 channel 160 that is formed into the housing 190 at the attachment connection 253 locations.

In operation, the front end 232 of the rod 230 is slid through the open end 161 of the channel 160 so that the strap 200 extending from the rod 230 slides through the open side 162 of the channel 160. The width and thickness of the strap 200 are configured to and dimensioned to correspond with the length and width of the open side 162 of the channel 160. The opposing end 163 of the channel 160 is not open but rather is closed to provide a hard stop when the rod 230 is inserted into the channel 160. The user can detach the strap 200 from the receiving channel 160, by sliding the rod 230 outward from the open end 161 of the channel and reconnect the strap at another location on the speaker that has the requisite channel 160 connection.

To better secure the rod 230 in a fixed position within the channel 160, the internal side of the receiving channel 160 can be provided with one or more bumps or protrusions (not shown) that can assist in securing or locking the inserted rod 230 within the channel 160 in the fixed position. The protrusion may be received within a corresponding recess in the rod 230 to further lock the rod in place or may be configured to facilitate retention of the rod 230 within the channel 160 via friction. Other types of locking mechanisms may be employed to secure the rod 230 in the receiving channel 160. For example, the receiving channel 160 may have a spring loaded protrusion or detent and the rod 230 may have a corresponding recess 236 or protrusions near the spring loaded elements in the channel 160, or vice versa.

The rod 230 and channel 160 connections provide a quick and easy attachment and detachment mechanism of strap 200 to the speaker housing 190 so that various handling or mounting configurations may be provided to fit the user's needs.

Figure 4:
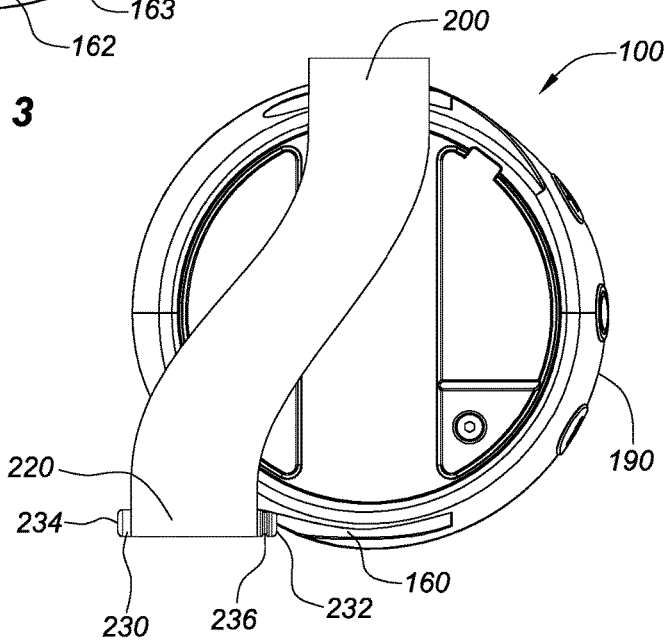
FIG. 4 is a rear view of the speaker illustrated in FIGS. 1-3 with one end of the strap being disconnected from the top side of the speaker and being positioned for connection to the bottom side of the speaker.
Figure 5:
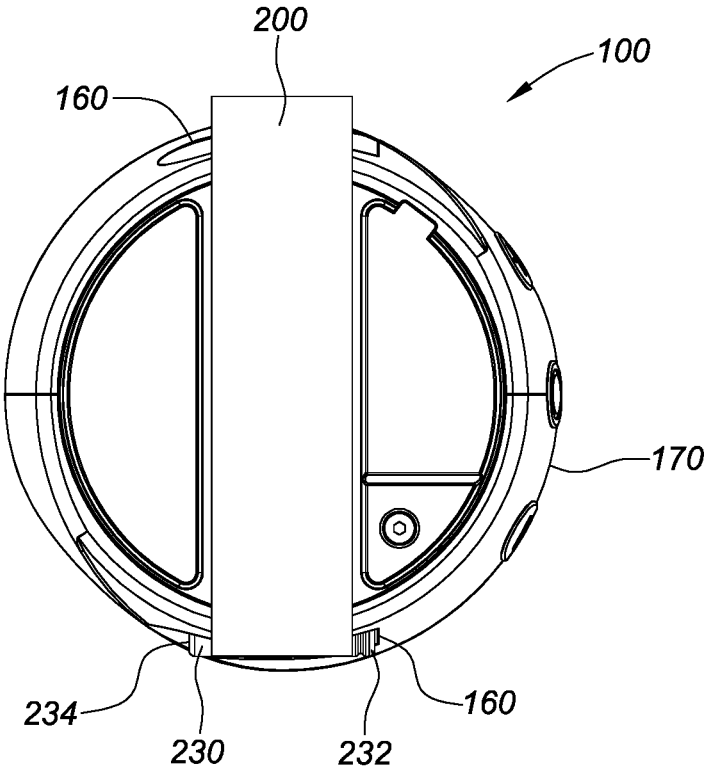
FIG. 5 is a rear view of the speaker illustrated in FIGS. 1-4 with one end of the strap being connected to the opposing bottom side of the speaker to form a second configuration position for handling or mounting.

Thus, for example, when the strap 200 is connected at both ends 210 and 220 to the top of the speaker housing 190 (as illustrated in FIGS. 1, 2A-2F), the strap 200 forms a loop that can be readily attached to a shower head or hung on a tree branch, a tent post, a backpack, a bicycle, a motorcycle, inside or outside of a vehicle, or other places as desired. When the strap 200 is connected to opposing sides of the speaker 100 (as illustrated in FIGS. 4 and 5), the strap 200 may be used to hold the speaker on the palm of the user's hand (with the strap 200 extending across the back of the user's hand) or may be suitable for strapping the speaker on a flat surface or plank or other objects.

The strap 200 is preferably made of synthetic materials, such as nylon. The opposing sides of the strap 200 may be differently constructed or may be identical to one another. For example, the inner side of the strap may include a layer of cushioning material or padding to provide comfort to the user when held in the user's hand. The strap 200 may also be configured or constructed to be adjustable in length or elastic so that it can stretch or be mechanically adjusted using tension or friction clips to different lengths to facilitate attachment to different objects more readily. It should also be understood that multiple straps 200 may be provided with the speaker 100 and that those straps 200 may be of different lengths and constructions but yet employ the same rod and channel connection mechanisms on either end as previously described above.

The housing 190 may be constructed of molded plastic or polymer and the receiving channels 160 may be molded into the housing. Similarly, the straps 200 may be constructed of molded materials such as plastic and the rods 230 or anchors located at one or more ends may be molded or co-molded with the strap 200.

While the disclosure has been described in connection with specific examples and various embodiments, it should be readily understood by those skilled in the art that many modifications and adaptations of the invention described herein are possible without departure from the spirit and scope of the invention as claimed hereinafter. Thus, it is to be clearly understood that this application is made only by way of example and not as a limitation on the scope of the invention claimed below. The description is intended to cover any variations, uses or adaptation of the invention following, in general, the principles of the invention, and including such departures from the present disclosure as come within the known and customary practice within the art to which the invention pertains.

The invention claimed is:

1. A battery powered audio speaker comprising:

a speaker housing having a first receiving channel positioned at a first wall of the housing and a second receiving channel positioned at a second wall of the housing, the second wall being substantially opposite the first wall of the housing;

a strap having a first end nondetachably secured to the housing and a second end opposite the first end; and a rod attached to the second end of the strap, wherein the rod is sized to be retentively received by the first receiving channel and the second receiving channel to secure the strap to the housing, wherein when the rod is retentively received by the first receiving channel, the second end of the strap is reversibly secured to the housing at the first receiving channel;

wherein when the rod is retentively received by the second receiving channel, the second end of the strap is reversibly secured to the housing at the second receiving channel.

2. The speaker of claim 1, wherein an inner surface of the first receiving channel includes a protrusion that engages with the exterior of the rod to secure the rod within the channel.

3. The speaker of claim 1, wherein the first receiving channel has a spring loaded protrusion provided inside the channel that is configured to engage with the rod.

4. The speaker of claim 3, wherein the rod is configured to engage the protrusion.

5. The speaker of claim 1, wherein each of the first and second receiving channels includes an open end and an open side.

6. The speaker of claim 1, wherein each of the first and second receiving channels are molded into the speaker housing.

7. The speaker of claim 1, wherein the strap comprises molded synthetic materials and the rod being molded or co-molded with the strap.

8. The speaker of claim 1, further including a second strap having a first and second end, wherein the first and second ends of the second strap each have a rod configured to be retentively received within the first and second receiving channels.

9. The speaker of claim 1, wherein the first end of the strap is nondetachably secured to the first wall of the housing.

10. The speaker of claim 9, wherein the first end of the strap is nondetachably secured next to the first receiving channel.

11. A battery powered audio speaker, the speaker comprising:

a speaker housing having a top side including a second attachment connection location molded into the top side of the speaker housing and a bottom side including a third attachment connection location molded into the bottom side of the speaker housing;

a strap having a first end and a second end, the first end of the strap being nondetachably secured to the top side of the speaker housing at a first attachment connection location, the second end of the strap being attachable and detachable to the speaker housing at the second attachment connection location, the second end of the strap being further attachable and detachable to the housing at the third attachment connection location;

wherein the second and third attachment connection locations are positioned on opposing top and bottom sides of the housing; and wherein the second end of the strap comprises a rod having a front end and a rear end, the rod being permanently attached at the second end of the strap at its mid- section and dimensioned and configured to be received within an open ended and open sided channel that is formed into the housing at one of the second and third attachment connection locations.

12. The speaker of claim 11, wherein when the rod is retentively received by the second attachment connection location, the second end of the strap is reversibly secured to the housing at the open ended and open sided channel.

13. The speaker of claim 11, wherein when the rod is retentively received by the open ended and open sided channel, the second end of the strap is reversibly secured to the housing at the open ended and open sided channel.

* * * * *